US008497472B2

(12) United States Patent
Höhndorf et al.

(10) Patent No.: US 8,497,472 B2
(45) Date of Patent: Jul. 30, 2013

(54) ASSESSING THE CONTAMINATION IN A MASS-SPECTROMETRIC MALDI ION SOURCE

(75) Inventors: Jens Höhndorf, Bremen (DE); Sebastian Böhm, Bremerhaven (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/417,962

(22) Filed: Mar. 12, 2012

(65) Prior Publication Data

US 2012/0228489 A1 Sep. 13, 2012

(30) Foreign Application Priority Data

Mar. 11, 2011 (DE) ..... 10 2011 013 653

(51) Int. Cl.
*H01J 49/26* (2006.01)

(52) U.S. Cl.
USPC ..... 250/282; 250/281

(58) Field of Classification Search
USPC ..... 250/281, 282
See application file for complete search history.

(56) References Cited

U.S. PATENT DOCUMENTS 7,485,855 B2 * 2/2009 Sundaram et al. ..... 250/288
7,541,597 B2 6/2009 Holle et al.
7,989,762 B2 8/2011 Holle et al.
2007/0114438 A1 * 5/2007 Holle et al. ..... 250/423 R
2007/0164205 A1 * 7/2007 Truche et al. ..... 250/281
2008/0067409 A1 3/2008 Corr et al.
2009/0200457 A1 * 8/2009 Holle et al. ..... 250/281
2010/0327159 A1 * 12/2010 Platow et al. ..... 250/283

OTHER PUBLICATIONS

Vestal, et al., "Delayed Extraction Matrix-assisted Laser Desorption Time-of-flight Mass spectrometry", Rapid Communications in Mass Spectrometry, vol. 9, 1044-1050, 1995.
Girard et al., "Determination of Quadrupole Charging in MS-MS Instruments", Journcal of Chromatography Science, 2010, 48 (9) 778-779.
Busch, "Ion Burn and the Dirt of Mass Spectrometry", online publication, Sep. 2010.

* cited by examiner

*Primary Examiner* — Michael Logie
(74) *Attorney, Agent, or Firm* — O'Shea Getz P.C.

(57) ABSTRACT

The invention relates to a method by which the operator of a mass spectrometer with a MALDI ion source, particularly one which operates with delayed extraction of the ions, is provided with a technique for determining the degree of contamination, in particular to determine when the ion source must be cleaned. The method comprises the acquisition of at least one mass spectrum of ions which are generated in the ion source, the recording of at least one characteristic value for each of at least two mass signals in the mass spectrum, and the determination of an indicator number, derived from the characteristic values of at least two mass signals, which shows how urgently the ion source must be cleaned. The invention also relates to a mass spectrometer with a MALDI ion source which can be characterized accordingly.

13 Claims, 3 Drawing Sheets

ASSESSING THE CONTAMINATION IN A MASS-SPECTROMETRIC MALDI ION SOURCE

PRIORITY INFORMATION

This patent application claims priority from German Patent Application 10 2011 013 653.3 filed on Mar. 11, 2011, which is hereby incorporated by reference.

FIELD OF THE INVENTION

The invention relates to a method for assessing the degree of contamination in a MALDI ion source, particularly one which operates with delayed extraction of the ions, in a mass spectrometer.

BACKGROUND OF THE INVENTION

Desorption ion sources, especially ion sources for ionization of samples by matrix-assisted laser desorption (MALDI), are used to ionize large molecules such as biomolecules or synthetic polymers. For special investigations, e.g., for mass spectrometric imaging of thin tissue sections, the ion sources must provide high sample throughput.

In desorption ion sources, a high-pressure desorption cloud is generated by bombardment of a sample with matrix and analyte material on a sample support plate with a short UV laser light pulse, usually a few nanoseconds in length. Analyte ions are formed in the plasma of the cloud by interaction with reactive ion species, which are generated from the desorbed matrix material in the desorption plasma as a consequence of the high laser energy input. After a largely uninfluenced expansion phase of some hundred nanoseconds, the ions are extracted from the desorption cloud by suddenly applying an accelerating field. The cloud, however, is not only a gaseous plasma; it sometimes also contains some splashes of solid or liquid matrix material from the quasi-explosion of the matrix material. As the cloud continues to expand, a portion of the vaporized and the splashed material is deposited on the first accelerating electrode, directly opposite the sample support, because of its close proximity of only a few millimeters to the MALDI sample support plate. But it is also possible that electrodes further downstream, a ground electrode, for example, may be affected.

When the desorption ion source is in operation, after several million laser shots, for example, a deposit of organic material builds up on the electrodes, sometimes visible by the naked eye. Such deposits in mass spectrometers are described in the literature by Girard et al. (Journal of Chromatography Science, 2010 October, 48 (9), 778-779) and Kenneth L. Busch ("Ion Burn and the Dirt of Mass Spectrometry", online publication, Sep. 1, 2010). With increasing thickness of the insulating organic deposit a higher and higher surface charge is generated when the ion source is in operation, and thus generates an increasing electrical interference field which is superimposed onto the desired electric field between the electrodes and the MALDI sample support plate, and thus interferes with the acceleration process. A noticeable effect of such a deposit is a decrease in the ion throughput in the mass analyzer connected to the desorption ion source. The reduced ion throughput in turn requires the additional acquisition and summation of spectra in order to maintain a specific quality level for the mass spectra. The reduction in the ion throughput limits the number of analyses which are possible per sample and reduces the detection limit of the mass spectrometer, which interferes with or prevents semi-quantitative comparative measurements. Another noticeable effect is a reduction of the mass resolution of the mass spectra. The paper by Girard et al. identified above describes a method where reversing of the polarity of the ion source, which changes the polarity of the ions to be analyzed, can neutralize the charging effect. Since ions of both polarities are produced in a MALDI method, the polarity of the accelerating field would therefore have to be reversed for analogous application of the method according to Girard et al. This method, however, only addresses the symptoms of the loss of throughput in the ion source and promises only a short-term effect. In high-throughput operation with 2,000 laser shots per second, the deposits are charged up again in only a few seconds.

The acquisition of a mass spectrometric image of a rather small area of one centimeter times two centimeters of an thin tissue section with 25 micrometer resolution requires 400×800=320,000 sum spectra. If each sum spectrum is added up from 200 individual mass spectra, a total of 64 million individual spectra have to be acquired, with 64 million laser shots and 64 million desorption plasma clouds. There are laser beam profiles developed for modern MALDI ion sources that no longer produce splashes of matrix material, but even with these new ion sources, a few milligrams of matrix material are vaporized and partially deposited on acceleration electrodes during spectra acquisition. With modern MALDI ion sources operating with 2 kHz laser shot repetition rate, the total acquisition time amounts to about only ten hours; but may require easily several cleaning periods to maintain the quality of the spectra.

Irrespective of the short-term solution mentioned above, there is therefore regularly a need to remove the deposit and thus restore the performance level of the mass spectrometer. If the cleaning is not able to restore the proper state of the ion source, the ion source may even have to be replaced with a new, clean one.

A relatively reliable but old-fashioned method for removing the deposit, which is still used in practice, is to clean the electrodes manually after venting and opening the ion source. The cleaning is usually carried out with solvents such as ethanol or acetone, but the electrodes can also be abraded if the contaminations are stubborn, and this can be carried out with or without the removal of the accelerating electrode from the ion source. If the mass spectrometer is vented during the disassembly, it often takes some hours before the required operating vacuum is restored after the ion source has been cleaned and re-inserted. In addition, the time needed to readjust, in the worst case even to completely recalibrate, the mass spectrometer with the cleaned or exchanged ion source may have to be added to this.

In practice it is found that, after a time, the ion and electron bombardment causes the deposits on the electrodes of the ion source to harden; this is probably due to a polymerization of the organic substance. This means that cleaning the electrodes becomes more difficult the longer the operating intervals between the cleanings are. An objective of cleaning as often as possible to prevent the hardening effect is problematic. Economic considerations mean that the ratio of maintenance time to operating time should be as low as possible. The problem for the operator is to detect the contamination easily and with certainty, preferably before it hardens and therefore before becoming too difficult to remove.

Several proposals have already been made to integrate cleaning devices into the ion source so that it is not necessary to break the vacuum in order to clean the electrodes. U.S. Pat. No. 7,989,762 B2 to Holle et al, assigned to the assignee of the present invention, describes an automatic vaporizing of deposits by flash heating the central part of the acceleration electrode. Up to now, however, it depends on the judgment of the operator as to when cleaning is necessary. Because these cleaning methods suffer from the problem that they are hardly effective once the contamination has reached a certain degree of hardness, it is necessary to detect contamination early enough, before it attains a state which is no longer cleanable.

There is a need for the operator of a mass spectrometer with a MALDI ion source to be provided with a means or a procedure of quantitatively detecting contamination in the MALDI ion source, in order to determine when cleaning is necessary.

SUMMARY OF THE INVENTION

According to an aspect of the present invention, a method for assessing the degree of contamination in a MALDI ion source in a mass spectrometer includes acquiring at least one mass spectrum of ions which are generated in the ion source, at least one characteristic value for each of at least two mass signals in the mass spectrum (or the mass spectra) is recorded, and a contamination indicator number which shows how urgently the ion source must be cleaned is determined from the characteristic values.

It has been found that the deposits and the associated electrostatic charges that build up when the ion source is in operation affect the behavior of different types of ion in different ways as they pass through the ion source and the mass spectrometer. The deposits leave a trace in the mass spectra which can be identified and used to quantify the degree of contamination of the exposed components in the ion source, such as the accelerating electrodes. An operator can thus determine when the ion source needs cleaning and which method must be used for the cleaning. Most favorably, the cleaning should be performed without having to break the vacuum of the ion source or the mass spectrometer every time.

An attempt is made below to explain the surprising behavior of ions of different mass-to-charge ratio m/z in an electrostatic interference field. Normally, ions in an electrostatic field cannot be separated according to their mass-to-charge ratio m/z, but only rather according to their kinetic energy. Consequently, on first sight, a comparison of the characteristic values of mass signals representing ions with different m/z would not provide any information about the possible presence of interfering electrostatic effects in the desorption region or the acceleration region. MALDI desorption, however, follows certain principles which cause individual ions to be differentiated according to their mass-to-charge ratio m/z by the interfering field.

In a MALDI ion source which nowadays operates exclusively with delayed extraction of the ions formed, the desorbed material generated by the laser bombardment expands in a high-pressure desorption cloud in the field-free region, or in the region that is at least intended by the operator to be field-free, before the accelerating voltage is switched on in order to extract the ions. A delayed extraction (DE) is used to greatly enhance the resolution of mass spectra generated with MALDI ion sources. The interaction between the ions and molecules in the high-pressure desorption cloud, which is dominated by viscous friction, during the initial stages of the adiabatic expansion (lasting a few ten nanoseconds), means that all the molecules and ions in the front of the cloud, regardless of their mass m and number of charges z, are accelerated by the friction to the same velocity. This velocity amounts to about 1,600 meters per second. Molecules and ions in the interior of the cloud have lower velocities, depending on their location in the expanding cloud, but independent on their mass m and number of charges z. This means that after expansion ions with different m/z have different kinetic energy distributions. During the delay period between laser bombardment and ion extraction, the latter by a sudden application of an accelerating voltage, specific spatial and momentum distributions form in the desorption region; these are affected in the course of time by the presence and strength of the electrostatic interference field caused by the charged deposits. The shape of the field in the desorption region changes by an increase of the charges on the deposits on the acceleration diaphragms. Ions from specific acceptance regions of these spatial and momentum distributions pass through the ion optics unhindered when the extraction is performed after the delay period, and are guided out of the desorption region, whereas ions from the regions of the spatial and momentum distributions which are beyond the acceptance regions cannot be transmitted; in other words, they are not accepted on the ion extraction paths, but collide with the surface of an ion-optical element, for example, and are thus neutralized (or even help to charge the deposits). The energy-dispersive effect of an electrostatic interference field causes the composition of the ions which are in the acceptance regions in the spatial and momentum distributions to change as a function of the ion energy. Since the different ions initially have a uniform velocity distribution, the heavy ions have, on average, higher kinetic energies than light ions, and so an electrostatic interference field can also have an indirect, mass-selective effect on ions with different m/z.

The indicator number derived from signals in the mass spectrum shows how urgently the ion source needs cleaning, particularly the accelerating electrode(s) assigned to this ion source, and in the simplest case can create a binary state space which contains the states zero and one. One of these states then preferably indicates that the level of contamination is such that cleaning is deemed necessary, whereas the other state indicates that the ion source can continue to operate for a while.

A binary state space of the indicator has been described above. It is also possible to select a state space which has several states, which makes it possible to represent a graduated increase of the cleaning urgency. The method to assess the contamination can be carried out at regular intervals when the ion source is in operation. It is possible, for example, to temporarily interrupt the measuring operation at fixed time intervals, if necessary, in order to determine the indicator number for assessing the cleaning urgency.

Where a mass spectrum is mentioned in this specification, it can be either an individual mass spectrum or a sum mass spectrum, which is generated by summing many (e.g., usually several hundreds to a thousand) individual mass spectra in order to achieve a better signal-to-noise ratio of the mass signals contained therein. Individual mass spectra can be acquired with a repetition rate of a thousand spectra per second, for example. Depending on the measurement settings, the sum of the mass signals in the individual mass spectra, in other words the mass signal signature of the spectrum, is usually brought about by around a thousand ions. Because the interference field in the ion source not only acts on the intensities of the ions but also on the focusing, the characteristic value or values of the mass signals can comprise the amplitude, area, width and/or symmetry of the mass signals. The amplitude is given by the intensity value of the signal maximum. The area of a mass signal is determined by the integrated (or summed) ion current intensity of the mass signal. The width of a mass signal usually forms a measure for the resolution of the ion current measurement and can be expressed by the full width at half maximum (FWHM), for example. The symmetry of a mass signal quantifies the particular shape or the particular contour characteristic. As a measure of the symmetry, the median of the mass signal, for example, can be used in comparison to the position of the signal maximum. The median is the position on the abscissa of the mass spectrum which divides the mass signal into two areas of equal size, in terms of the number of the counts in the detector, toward smaller and larger mass-to-charge ratios m/z respectively.

The indicator number is established by determining at least one of the types of characteristic values for each of two mass signals in the mass spectrum which can be distinguished from each other, and then forming their ratio. This makes use of the fact that the deposits with the associated electrostatic charges in the ion source have an energy-dispersive effect on the ions generated, i.e., they separate lower-energy ions from those with higher energy by a velocity drift, before an accelerating voltage can then be applied in the region between MALDI sample support and accelerating electrode after a pre-determined delay time. Assuming that when the ion source is in operation for a prolonged period with a specific electrical polarity, the electrostatic charging also has a specific polarity, particularly one which repels or attracts the ions, then light ions with their low kinetic energy, which results from the specific MALDI desorption and plasma expansion process, are subjected to a stronger interfering effect than ions which are comparatively heavier, with high kinetic energy. A plausibility consideration is therefore sufficient to derive a measure for the contamination on the electrodes in the ion source on the basis of the different throughputs (characterized, for example, by the intensity or amplitude of the corresponding mass signals) for ions with kinetic energies which differ from each other.

In a simple example, the ratio is formed of the amplitudes of two mass signals which are resolved separately from each other in a mass spectrum. Since the amplitude (just like the area integral of a mass signal) is usually an integer value (i.e., the number of counts) the ratio always forms a rational number as the indicator. The amplitude of the mass signal of the lighter ion should be in the numerator when the ratio is formed so that, if it vanishes completely in the noise, a singularity cannot be formed, which may cause problems particularly with automated assessment or evaluation algorithms. The smaller the indicator number, the more contaminated the electrodes can be assumed to be. A threshold value for the indicator can then be defined, particularly with the aid of empirical findings; if the value drops below the threshold, this indicates cleaning will be necessary. This threshold is preferably selected as a function of the ratio of the abundance of the ions with different mass-to-charge ratios in the quasi-ideal clean state of the ion source.

In a MALDI ion source, mass signals that originate from matrix ions can be used to determine the indicator number. The advantage of matrix ions is that they are always present in sufficient quantities, and their omnipresence means that the contamination assessment can be carried out at the same time as the analyte ions are being measured. In this specific embodiment there is no need to interrupt the analytical measurement because of special characterization intervals. Sample supports that are pre-coated with a matrix substance are known in the prior art. These can be used with the method proposed here in a simple and user-friendly way to assess how contaminated an ion source is without having to apply an analyte substance.

If matrix ions are used to determine the indicator number and if the mass spectrometer is equipped with corresponding cleaning mechanism, the whole cleaning process can be automated. Usually, the ions of the matrix are deflected during the acquisition of mass spectra in order not to overload the ion detector. For an automated measurement of the indicator number, the deflection will occasionally be switched off, the matrix ions will be measured, and the indicator number will be determined. If the indicator number indicates that cleaning is necessary, a cleaning procedure can be carried out automatically by the control system of the mass spectrometer.

If matrix ions cannot be used, special reference samples may be prepared on each sample support plate, together with analyte samples. The reference samples can contain substances, the signals of which are particularly suitable for the determination of contamination indicator numbers.

Mass signals can be used which originate from the same ion in different charge states or molecular states. Here, the term "molecular states" indicates the polymer state (e.g., monomer, dimer, trimer etc.) in the gaseous phase. The mass signals can, furthermore, originate from the lower range of the mass-to-charge ratios m/z, particularly from the range between around 150 and around 500 atomic mass units.

The mass signals whose characteristic values are determined and ratioed to determine the indicator number can differ by around 100 to around 250 atomic mass units, particularly by around 150 to around 200 atomic mass units ($\Delta m/z$). A certain minimum separation on the abscissa of a mass spectrum is advantageous because this makes the effects of the deposits on the characteristic values clearer to see and they are easier to determine In ion sources which are subject to contamination in a particularly reproducible way, the indicator number can be determined from the ratio of the characteristic values with the aid of a look-up table. Such a table preferably lists the ratio of the values for at least one characteristic as a function of the degree of contamination of the ion source. This requires a calibration method to be carried out beforehand, where, starting from the quasi-ideal clean state of the ion source, the degree of contamination with increasing length of operation is recorded, and corresponding ratios of the characteristic values of the mass signals are assigned. This allows a particularly reliable urgency forecast to be generated with the aid of the indicator number. It is preferable for the table to be structured so that certain intervals of the characteristic values are assigned to an indicator value. But it is also possible to interpolate or extrapolate table entries with certain discrete separations using a computational algorithm to convert a specific characteristic value ratio, which has no direct correspondence in the table, into an indicator number.

The look-up table can list the conversion of the ratios into an indicator number for at least one, in particular for several different, delay times between 30 and 1000 nanoseconds for the acceleration after laser bombardment, particularly between 300 and 700 nanoseconds, preferably between 400 and 500 nanoseconds. This is based on the fact that ions with low kinetic energy, subjected to an electrostatic interference field for a prolonged period, experience a greater velocity change than ions with a high kinetic energy (with the same charge). The informative value of the indicator number can thus be further improved with an additional parameter; for example by forming the ratio of the characteristic values of mass signals in mass spectra which are acquired at two or more delay times; the sections of the look-up table which contain the conversion factors for the corresponding different delay times can then be used to determine several individual indicator numbers which are related to the delay times, and these individual indicators are computed, in a final step, to provide an overall indicator, for example by averaging, or by a functional relationship. In order to keep the mass resolution somewhat constant, the extraction voltage has to be changed if the delay time is changed; this compensation, however, works only in a limited range of changes. It is therefore particularly favorable to record a mass spectrum at a delay time for which conversion values are contained in the look-up table. It is preferable for at least two mass spectra to be acquired at different ion extraction delay times.

More than one characteristic value for the mass signals can be recorded and evaluated; the amplitude, the area, the width, the symmetry or any combination thereof, for example, in the same mass spectra; either in relation to the same or different mass signals or pairs of mass signals. The informative value of the assessment of the degree of contamination can thus be put on a broader footing.

In one embodiment, a preset voltage for setting a largely field-free region in the desorption region of a sample support of the matrix-assisted laser desorption and ionization can be incorporated into the determination of the indicator number. Such leveling voltages are, for example, applied to a first accelerating electrode which is directly opposite a MALDI sample support, regardless of the degree of contamination, i.e., also when the electrode is in a clean state, in order to achieve an optimum ion yield at the ion detector. These leveling voltages can be regarded as adaptation parameters to compensate for field leaks reaching through the first accelerating electrode from a ground electrode positioned at a relatively large distance from the sample support ("back bias adjustment"). The optimum leveling voltage will be dependent on deposits on an accelerating electrode with the associated electrostatic charges. As explained hereinafter, the relation between optimum leveling voltage and contamination can be investigated and used to determine an indicator number to show the degree of contamination. If the leveling voltage is optimized to a specific value in the ideal-clean state of the MALDI ion source, the deviation of the optimum leveling voltage from this initial value as a consequence of the contamination on the ion source can be used to derive the degree of contamination.

These and other objects, features and advantages of the present invention will become more apparent in light of the following detailed description of preferred embodiments thereof, as illustrated in the accompanying Figures.

BRIEF DESCRIPTION OF THE DRAWING

In the following, the invention is described by example embodiments in conjunction with the attached drawings. The drawings illustrate the foundations of the invention and are schematic in nature. The drawings show.

DETAILED DESCRIPTION OF THE INVENTION

Figure 1A:
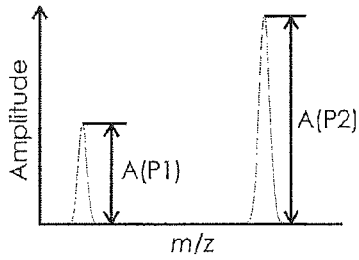
FIGS. 1A to 1D illustrate mass spectra with mass signals, on which characteristics that are suitable for determining the indicator number are pointed out.

FIG. 1A shows a mass spectrum with two mass signals P1 and P2. For clarity, only two mass signals are shown. A real mass spectrum usually contains a large number of different mass signals from which an appropriate number of suitable mass signals may then be selected. P1 here has a lower mass-to-charge ratio m/z than P2, and also a lower amplitude A(P1) than the amplitude A(P2) of P2. The amplitude A(Pn) here indicates the signal's maximum above zero. The mass signals are depicted here as symmetric curves for simplicity. It is obvious that they can also be asymmetric, however. If the amplitudes A(P1) and A(P2) are expressed as a ratio, where the value of the mass signal with the higher mass-to-charge ratio should be in the denominator because it is less sensitive to electrostatic interference field effects, an indicator number is produced which can be used to judge whether the contamination on the electrodes in the ion source has already exceeded a degree which allows it to operate largely without interference.

This procedure is based on the finding that deposits and the associated electrostatic charges have an energy-dispersive and thus a mass-dispersive effect on ions with approximately the same flight velocity but different mass-to-charge ratios, due to the interaction-specific characteristics of the desorption cloud. Light ions with low kinetic energy experience a greater velocity and direction change as result of the interference field than heavy ions with high kinetic energy (when both have approximately the same initial velocity), so they are more likely to leave the acceptance ranges in position and momentum space and can no longer be extracted when the accelerating voltage is switched on. This manifests itself in the number of counts on the ion detector in such a way that the amplitude of the mass signal of the ion with initially lower kinetic energy, and thus lower mass-to-charge ratio, is reduced in relation to the mass signal of the ion with high kinetic energy, and thus high mass-to-charge ratio. By defining a threshold value which, in the simplest case, divides the indicator space into a first interval which indicates that cleaning is required, and a second interval which indicates that it is deemed safe to continue the measuring operation, the operator is provided with a tool obtained by acquiring and evaluating with a reasonable effort at least one mass spectrum which helps him decide whether he should interrupt the measuring operation for cleaning purposes or whether he can continue until the next characterization measurement. It is contemplated that the indicator number must not necessarily be binary; it can also have a more complex form.

In a MALDI ion source, mass signals that originate from matrix ions can be selected advantageously to determine the characteristic values. For the alpha-cyano-hydroxy-cinnamic acid (CHCA) matrix, for example, the mass signals at 190 and 379 atomic mass units (monomer and dimer) can be used. The separation of nearly 200 u ensures that the effects of the deposits on the ions with different mass-to-charge ratios are significantly different, which then results in specific amplitude ratios of the mass signals, for example. Other possible matrix substances with suitable monomers and dimers are: sinapinic acid (monomer at 225 u/dimer at 449 u); 3-hydroxypicolinic acid (140/279 u); 4'-hydroxyazobenzene-2-carboxylic acid (243/485 u); 2,5-dihydroxybenzoic acid (155/309 u); 2,4,6-trihydroxyacetophenone (187/373 u); T-2-(3-(4-t-butyl-phenyl)-2-methyl-2-propenylidene)malononitrile (250/499 u); 6-methyl-3-thioxo-2H-1,2,4-triazin-5-one (143/285 u); 1,8-dihydroxyanthracen-9(10H)-one (226/451 u); (2E)-3-(4-hydroxy-3-methoxyphenyl)acrylic acid (194/387 u); 2-[(Z)-(4-hydroxyphenyl)diazenyl]benzoic acid (242/483 u); (2E)-3-(1H-indol-3-yl)acrylic acid (187/373 u); 4-hydroxy-3-methoxybenzoic acid (168/335 u); 4-methyl-5-nitro-pyridin-2-amine (153/305 u); 4-nitroaniline (138/275 u); naphthalene-1,5-diamine (158/315 u) or 3-methyl-2(5H)-furanone (99/197 u).

In one embodiment of the method, an optimized leveling voltage can be incorporated into the determination of the indicator number. This voltage is applied to the first accelerating electrode and serves to set a region that is largely field-free in front of the desorption region of a MALDI sample support in order to achieve maximum ion throughput across the whole spectrum of mass-to-charge ratios. If one assumes that deposits on the accelerating electrode, with the associated electrostatic charges, affect the optimum leveling voltage in a reproducible way, the degree of contamination on the accelerating electrode can be correlated with the optimum setting of the leveling voltage. The change in the optimum leveling voltage as the level of contamination increases depends on the polarity of the charging which accompanies the contamination, and can be proportional or inversely proportional. This means that the leveling voltage may have to be increased or decreased as the contamination increases.

The principle of indicator determination can therefore be used regardless of the dependence described above.

Figure 1B:
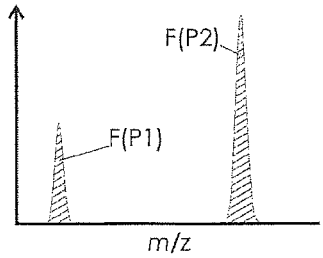

FIG. 1B shows the same example mass spectrum as FIG. 1A, but here the area of the mass signal F(P1) and F(P2) as the characteristic is emphasized by hatching. On the one hand, slightly more effort is required to determine the area F(Pn) below a mass signal than to simply determine the signal amplitude. On the other hand, the increase in the counts to be taken into account with the area F(Pn) improves the info i native value of the indicator number. Furthermore, the area F(Pn) of a mass signal is largely independent of its shape, so mass signal distortions, which can have causes other than the deposits on the electrodes, have very little or no influence on the determination of the indicator number.

Figure 1C:
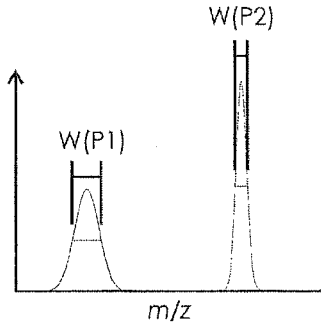
Figure 1D:
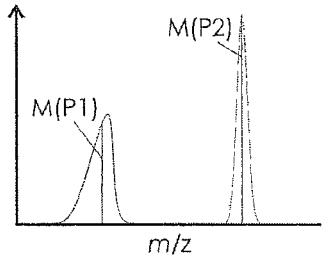

FIGS. 1C and 1D show two additional illustrated characteristics of a mass signal that can be used in principle to determine the indicator number. In FIG. 1C, a measure for the resolution is selected, namely in this example the full width at half maximum W(P1) and W(P2) of the mass signals. It is obvious that the width of the mass signal can also be used at a different level than half the signal amplitude without changing the principle of the indicator determination. The resolution can serve as the basis for determining the indicator because it also is dependent on the deposits, with the associated electrostatic charges, due to a possibly defocusing effect of the interference field, where the interference field has an energy-dispersive effect on the ions.

The bottom FIG. 1D shows two mass signals, of which the left one shows an asymmetric contour. This distortion can also be used as a scale to assess the degree of contamination, by quantifying the distortion or asymmetry, for example. In the example shown, this is achieved with the aid of the medians M(P1) and M(P2) plotted in the mass signals. The median divides the area of the mass signals into two regions with identical incidence, i.e., equal numbers of counts on the ion detector. For a mass signal in the ideal state of the ion source (with no contamination), the median will agree with the position of the signal maximum. With increasing contamination, deviations from this agreement can then occur, shifting the position of the median from the position of the signal maximum. This difference in position (median to signal maximum) can also be used to determine the indicator number by forming a ratio. The positional difference of the one mass signal can be divided by the positional difference of the other mass signal, for example.

FIGS. 1A to 1D all have in common that some characteristics of the mass signals remain the same relative to each other in the representation. In particular, the mass signals at small mass-to-charge ratios are shown with a lower intensity than the mass signals at high mass-to-charge ratios. These common features are to be understood solely as an example, however, and should not exclude the cases where the different characteristics are distributed arbitrarily over the mass signals of the different ions with different m/z Important for the method proposed here is rather the change in the characteristics with increasing (or variable) contamination on the electrodes.

Figure 2A:
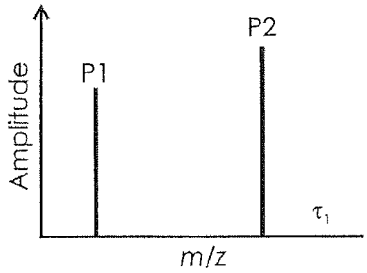
FIGS. 2A and 2B illustrate mass spectra illustrating the change of the mass signal amplitudes with the delay time i between ionization and acceleration.
Figure 2B:
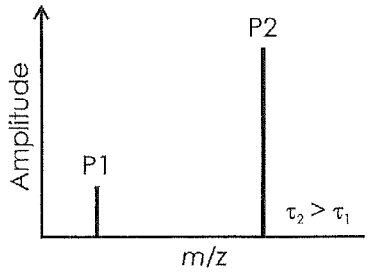

FIGS. 2A and 2B are pictorial illustrations relating to a method where, in addition to recording characteristic values, a variation of the delay time $\tau$ between the ionization and the acceleration of the ions is included in the determination of the indicator number. This embodiment is used in MALDI methods with delayed acceleration, as are described by Vestal et al. ("Delayed Extraction Matrix-assisted Laser Desorption Time-of-flight Mass Spectrometry", Rapid Communications in Mass Spectrometry, Vol. 9, 1044-1050, 1995), for example. Conventionally, delayed extraction (DE) is used in all MALDI ion sources because DE greatly enhances the resolution of the mass spectra. As the specialist in the field knows, the delay time can be varied within a certain range, but the variation has to be accompanied by a compensating change of the strength of the extraction field to keep the mass resolution. The mass signals P1 and P2 are shown only as lines in the drawings for simplification. The mass spectrum shown in FIG. 2A was acquired at a delay time $\tau_1$. Certain amplitudes result for the mass signals P1 and P2. In a further cycle, illustrated in FIG. 2B, a delay time $\tau_2$ is selected which is longer than $\tau_1$. An electrostatic interference field that possibly exists between the electrodes and a MALDI sample support acts on the ions, which are volatilized after desorption, for longer, in accordance with the time difference $\tau_2-\tau_1=\Delta\tau$. Ions with low kinetic energy experience a greater change in velocity due to the interference field acceleration and are therefore removed in greater numbers from the ion population until the accelerating voltage is switched on; in other words, more ions leave the acceptance regions in the position and momentum distribution space. Ions with higher kinetic energy, on the other hand, are not so strongly affected, so the amplitude ratio, and therefore the area ratio, which is not shown, shifts in favor of P2. Corresponding changes to the ratios can be attributed to the degree of contamination on the electrodes of the ion source and provide the operator with an indication of whether cleaning is necessary or not. This means that the degree of contamination on the electrodes can be judged by ascertaining the signal amplitude ratio or signal area ratio of two mass signals in several mass spectra which are acquired with different delay times $\tau_n$. The delay times can be varied between 30 and 1000 nanoseconds. A temporal separation $\Delta\tau$ between the two delay times $\tau_1$, $\tau_2$ between 200 and 900 nanoseconds, particularly between 300 and 800 nanoseconds, preferably between 400 and 700 nanoseconds, more preferably between 500 and 600 nanoseconds, makes the different effects on ions with differing kinetic energy (or differing m/z) stand out well.

Figure 3:
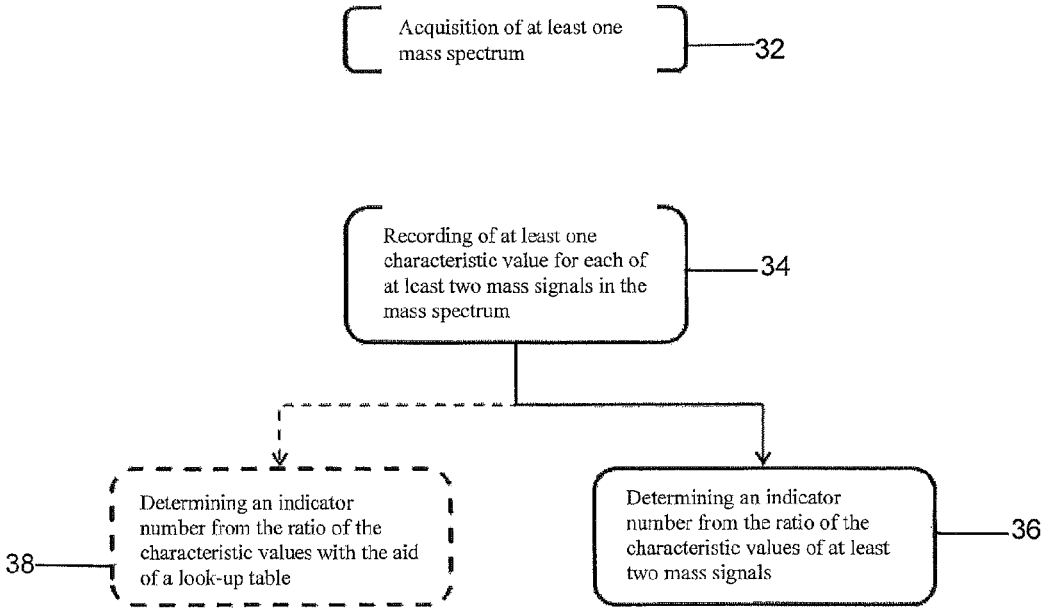
FIG. 3 is a flow diagram illustration of an embodiment of a method according to an aspect of the present invention.

FIG. 3 is a flow diagram that shows an example of a method sequence 30 for assessing the degree of contamination in a MALDI ion source operating with delayed extraction of the ions. At least one mass spectrum of ions that are generated in an ion source is acquired in step 32. In step 34, at least one characteristic value for at least two mass signals in the mass spectrum is recorded in each case. An indicator number which shows how urgently the ion source needs cleaning is then determined in step 36 from the ratio of the characteristic values of at least two mass signals. As an option, the indicator number can be determined in step 38 from the ratio of the characteristic values with the aid of a look-up table which lists the ratio of the values for at least one characteristic as a function of the degree of contamination of the ion source.

In the future, MALDI mass spectrometers will regularly be equipped with means for cleaning the ion source automatically without breaking the vacuum. Cleaning may be performed by evaporation of the contaminants on the central part of the acceleration electrode, for instance by infrared flash heating. If matrix ions can be used to determine the indicator number, as for instance in mass spectrometric imaging of thin tissue sections, the whole cleaning process can be easily automated. The indicator number will be determined regularly after a preset number of laser shots, e.g., two million. Usually, the ions of the matrix are deflected by a pair of deflection plates in the flight path during the acquisition of mass spectra in order not to overload the ion detector. For an automated measurement of the indicator number, the deflection will be switched off, the matrix ions will be measured, and the indicator number will be determined If the indicator number indicates that cleaning is necessary, the cleaning procedure can be carried out automatically by the control system of the mass spectrometer.

After the cleaning process, a further determination of the indicator number may show the success of the cleaning. It is to be expected that the cleaning success decreases after a large number of successful cleaning procedures due to the increasing presence of polymerized material; the ion source then may have to be cleaned with breaking the vacuum. If matrix ions cannot be used for the determination of the contamination indicator number, special reference samples may be prepared on each sample support plate, together with analyte samples. The reference samples should contain substances, the signals of which are particularly suitable for the determination of contamination indicator numbers.

Although the present invention has been illustrated and described with respect to several preferred embodiments thereof, various changes, omissions and additions to the form and detail thereof, may be made therein, without departing from the spirit and scope of the invention.

What is claimed is:

1. A method for assessing the contamination in a MALDI ion source in a mass spectrometer, comprising the steps:

acquiring at least one mass spectrum of ions which are generated in the ion source;

recording at least one characteristic value for at least two mass signals in the mass spectrum in each case; and determining a contamination indicator number which uses the characteristic values of the at least two mass signals to indicate how urgent it is that the ion source be cleaned.

2. A method according to claim 1, wherein the characteristic value of the mass signals is recorded from the group comprising: maximum amplitude, area, width or symmetry.

3. A method according to claim 1, wherein the mass signals selected originate from matrix ions.

4. A method according to claim 1, wherein the mass signals selected originate from a special sample preparation.

5. A method according to claim 1, wherein mass signals are used which originate from the same ion in different charge states or molecular states.

6. A method according to claim 1, wherein the mass signals used are from a lower range of the mass-to-charge ratios m/z, namely between about 150 and 500 atomic mass units.

7. A method according to claim 1, wherein the mass signals used differ by around about 100 to 250 atomic mass units.

8. A method according to claim 1, wherein the contamination indicator number can be determined from a ratio of the characteristic values with the aid of a look-up table which lists the ratio of the values for at least one characteristic as a function of a degree of contamination of the ion source.

9. A method according to claim 8, wherein the look-up table lists a conversion of the ratios into an indicator number for at least one delay time for an acceleration after ion formation between about 30 and 1000 nanoseconds.

10. A method according to claim 9, wherein a mass spectrum is acquired at a delay time for which conversion values are recorded in the look-up table.

11. A method according to claim 1, wherein during the step of determining an optimum leveling voltage for a generation of a largely field-free region in a desorption area of a MALDI sample support is incorporated into the determination of the indicator number.

12. A method according to claim 1, wherein several individual indicator numbers are determined which are subsequently computed to derive an overall indicator.

13. A method according to claim 1, wherein, when the contamination indicator number indicates the necessity for cleaning, an automatic cleaning procedure is performed.

* * * * *

UNITED STATES PATENT AND TRADEMARK OFFICE

CERTIFICATE OF CORRECTION

PATENT NO. : 8,497,472 B2
APPLICATION NO. : 13/417962
DATED : July 30, 2013
INVENTOR(S) : Hohndorf et al.

It is certified that error appears in the above-identified patent and that said Letters Patent is hereby corrected as shown below:

In the Specification

Column 9
Lines 22-23, delete "info i native" and insert --informative--

Signed and Sealed this
Fifteenth Day of October, 2013

Teresa Stanek Rea
*Deputy Director of the United States Patent and Trademark Office*